US012798833B2

(12) United States Patent
Salvado et al.

(10) Patent No.: US 12,798,833 B2
(45) Date of Patent: Nov. 17, 2026

(54) CONTAINER TAMPER DETECTION CAPSULE, CAPSULE OPERATION PROCESS AND CONTAINER TAMPER DETECTION PROCESS

(71) Applicant: AMORIM TOP SERIES, SA, Argoncilhe (PT)

(72) Inventors: Pedro Miguel Godinho Salvado, Albergaria a Velha (PT); Sarah Lagorsse De Ribeiro Pontes, Oporto (PT)

(73) Assignee: AMORIM TOP SERIES, SA, Argoncilhe (PT)

( * ) Notice: Subject to any disclaimer, the term of this patent is extended or adjusted under 35 U.S.C. 154(b) by 0 days.

(21) Appl. No.: 19/115,617

(22) PCT Filed: Sep. 26, 2023

(86) PCT No.: PCT/PT2023/050032
§ 371 (c)(1),
(2) Date: Mar. 26, 2025

(87) PCT Pub. No.: WO2024/072246
PCT Pub. Date: Apr. 4, 2024

(65) Prior Publication Data

US 2026/0103312 A1 Apr. 16, 2026

(30) Foreign Application Priority Data

Sep. 26, 2022 (PT) ..... 118216

(51) Int. Cl.
*B65D 39/00* (2006.01)

(52) U.S. Cl.
CPC ..... *B65D 39/0052* (2013.01); *B65D 2203/10* (2013.01); *B65D 2401/00* (2020.05)

(58) Field of Classification Search
CPC ..... B65D 39/0052; B65D 2203/10; B65D 2401/00; B65D 39/0076; B65D 39/00; B65D 41/28; B65D 41/58; B65D 55/02
See application file for complete search history.

(56) References Cited

U.S. PATENT DOCUMENTS 5,803,285 A * 9/1998 Hirota ..... B65D 39/16 81/3.15
2017/0021985 A1* 1/2017 dos Santos Sobreira ..... B65D 39/0058
2025/0242985 A1* 7/2025 De Oliveira ..... B65D 39/16

FOREIGN PATENT DOCUMENTS

EP 3146644 B1 1/2019
EP 3146642 B1 7/2019
(Continued)

OTHER PUBLICATIONS

International Search Report and Written Opinion issued by the International Searching Authority in International Patent Application No. PCT/PT2023/050032, mailed Jan. 30, 2024.

*Primary Examiner* — Andrew D Perreault
(74) *Attorney, Agent, or Firm* — ArentFox Schiff LLP

(57) ABSTRACT

A container tamper detection capsule comprising a top cover member, a lid member, an NFC tag adhesive, a drive member and a ring member, wherein the drive member is configured to move within the ring member between i) a first closed position, on which the secondary component is glued to the ring member, and ii) a second opened position, on which the secondary component is separated from the main component of the NFC tag adhesive, and the drive member is immobilized, both axially and longitudinally, in the ring member, being at the lower part of the latter member a stopper member inserted and immobilized. The invention
(Continued)

further relates to a process of operating the container tamper detection capsule and to a container tamper detection process.

6 Claims, 8 Drawing Sheets

(56) References Cited

FOREIGN PATENT DOCUMENTS

| | | | |
|---|---|---|---|
| EP | 3146645 | B1 | 7/2019 |
| IT | 201900001537 | A1 | 8/2020 |
| PT | 108721 | A1 | 1/2017 |
| WO | 2014/12230 | A1 | 8/2014 |
| WO | 2014/122300 | A1 | 8/2014 |

* cited by examiner

CONTAINER TAMPER DETECTION CAPSULE, CAPSULE OPERATION PROCESS AND CONTAINER TAMPER DETECTION PROCESS

CROSS-REFERENCE TO RELATED APPLICATIONS

This application is a National Stage Entry of International Application No. PCT/PT2023/050032, filed Sep. 26, 2023, which claims priority to Portuguese Patent Application No. 118216, filed on Sep. 26, 2022, the disclosure of each of which are hereby incorporated by reference in their entireties.

FIELD OF THE INVENTION

The present invention relates to a container tamper detection capsule, designed to provide information to a user of the existence of an attempt to tamper with the container closed with such a capsule. The invention further relates to an operating process of the capsule (1) for detecting container tampering and to a container tamper detection process.

The invention has application in the field of production and marketing of capsules for all types of containers, in particular beverage bottles and mainly for application in the field of cork production in the cork industry sector.

BACKGROUND OF THE INVENTION

In the state of the art, it is well known to use capsules with mechanisms that make it possible to easily identify the first time a container closed with such a capsule is opened, particularly in bottles of beverages or food products. Many of these capsules that are currently on the market constitute systems susceptible to be damaged, that is to say, when first opening a container closed with such a capsule, it is necessary to partially damage such capsule, or else it is completely damaged the first time that is removed from the container.

Another problem found in these capsules is the reversibility of the mechanisms that allow them to operate. That is to say, if the function of these capsules is to inform consumers about the first opening of a container closed with such a capsule, it is imperative that this capsule does not present faults with regard to the irreversibility of its operating mechanism, otherwise the reversibility of its operating mechanism can be used by a hypothetical counterfeiter to circumvent the security and authenticity of the capsule.

Document WO 2014/122300 discloses a capsule with a mechanism that allows a user to identify whether a container closed with such a capsule has been tampered with. The disclosed capsule consists of a top lid, a spring, an inner member and an outer cylindrical member, movable relative to the inner member, from a first position corresponding to the closed position, before the first opening of the container, to a second position, after a user removes the capsule. The operating mechanism acts so that when the capsule is removed from the container for the first time, that is to say, when the capsule is triggered for the first time, the spring, fixedly housed in the inner member, cooperates with the outer cylindrical member and allows to block such outer cylindrical member relative to the inner member, in said second position, showing a change in the shape of the capsule which allows a user to identify tampering with the container. However, the design of the capsule disclosed in this prior art document allows a user to breach a closed container with such capsule without actuate the detection mechanism, that is to say, it makes it possible to remove the capsule (and respective stopper) from the container without actuating the mechanism. In some embodiments of said capsule, it is also possible to unlock its detection mechanism after its activation and return it to the original safety position. This weakness allows the capsule (and its cork) to be removed from the bottle and then, after restoring its original detection configuration, reinserted into the same container or another, without leaving any evidence of its tampering.

In turn, document PT 108721 (A) discloses a container tamper detection capsule that provides information to a user about the existence of an attempt to tamper with the container closed with such a capsule. This capsule comprises an top cover member, an inner spring support member, a spring member and a lower cover member, wherein the spring member is movable between i) a first closed position, on which it is arranged on the inner member, and ii) a second opened position, on which it is arranged between the inner member and the top cover member, SO as to lock the capsule mechanism in the second opened position. When the capsule disclosed in this document is tampered with, its detection mechanism is triggered and a change occurs in the shape of the capsule, allowing the user to identify the existence of an attempt to tamper with the closed container. This capsule comes to solve the technical problem of the weakness of the preceding document WO 2014/122300, that is to say, flaws relative to the irreversibility of its detection mechanism. However, it is necessary for the tamper detection mechanism of this capsule to produce a change in the shape of the capsule, so that the user can identify the existence of an attempt to tamper with the closed container, and therefore, the visual appearance of the capsule is changed.

There are still some documents in the state of the art that refer to the application of NFC technology to verify the authenticity of the contents of a bottle. For example, documents EP 3146642 (B1), EP 3146644 (B1) and EP 3146645 (B1) disclose near-field magnetically coupled contactless identification devices, for example, NFC devices, for ensuring the authenticity of the contents of a bottle.

Thus, in accordance with the foregoing, there is a need in the art for a container tamper detection capsule with a detection mechanism that does not damage or aesthetically alter the capsule, and that is irreversible, that is, that does not allow security and authenticity of the capsule to be circumvented after it has been tampered with. There is also a need for a capsule that allows to detect tamper or attempted tamper in a simple way by electronic means.

SUMMARY OF THE INVENTION

The present invention relates to a container tamper detection capsule (1) comprising:

a top cover member (2),
a lid member (3),
an NFC tag adhesive (4),
a drive member (5) and
a ring member (6),
wherein
the NFC tag adhesive (4) comprises a main component (4*a*) and a secondary component (4*b*), with the main component (4*a*) being glued to the drive member (5) and the secondary component (4*b*) glued to an inner side wall of the ring member (6), the lid member (3) is arranged jointly to the NFC detection member (4), forming the lid member (3), the NFC detection member (4) and the drive member (5) a joint assembly, and the ring member (6) contains the drive member (5) within and is closed by the lid member (3), the drive member (5) is configured to move within the ring member (6) between:

i) a first closed position, on which the secondary component (4*b*) is glued to the ring member (6), and ii) a second opened position, on which the secondary component (4*b*) is separated from the main component (4*a*) of the NFC tag adhesive (4), and the drive member (5) is immobilized, both axially and longitudinally, on the ring member (6).

Consequently, the drive member (5) is susceptible of assuming two alternative positions within the ring member (6), a first closed position or a second opened position.

In a preferred embodiment, the capsule (1) further comprises a stopper member (7) inserted and immobilized in the lower part of the ring member (6). In another embodiment of the present invention, the top cover member (2) is arranged in a way as to externally cover said assembly formed by said members (3, 4, 5 and 6).

In one aspect, the stopper member (7) is made in a material selected from the group consisting of plastic, wood, cork, composites and combinations thereof.

In another aspect, the top cover member (2) is made in a material selected from the group consisting of plastic, wood, cork, composites and combinations thereof.

The present invention also relates to a process of operating the capsule (1) which comprises the step of moving, from a first closed position to a second opened position, the assembly formed by the drive member (5), the NFC tag adhesive (4), and lid member (3) relative to the ring member (6), wherein in the first closed position, the main component (4*a*) of the NFC tag adhesive (4) is glued to the drive member (5) and the secondary component (4*b*) of the NFC tag adhesive (4) is glued to an inner side wall of the ring member (6); and in the second opened position a secondary component (4*b*) of the NFC tag adhesive (4) is physically separated from the main component (4*a*) of the NFC tag adhesive (4).

The present invention further relates to a container tamper detection process comprising the step of electronically detecting the physical integrity of an NFC tag adhesive (4) integrated into a container stopper capsule.

In a preferred embodiment, said container tamper detection process further comprises the step of electronically detecting the physical separation of a secondary component (4*b*) relative to a main component (4*a*), both constituents of said NFC tag adhesive (4).

The capsule of the present invention is suitable for closing containers containing a beverage selected from the group consisting of wine, beer, spirits, water and soft beverages.

BRIEF DESCRIPTION OF THE DRAWINGS

Below is a detailed description of the invention with reference to the attached drawings, wherein.

DETAILED DESCRIPTION OF THE INVENTION

Figure 1:
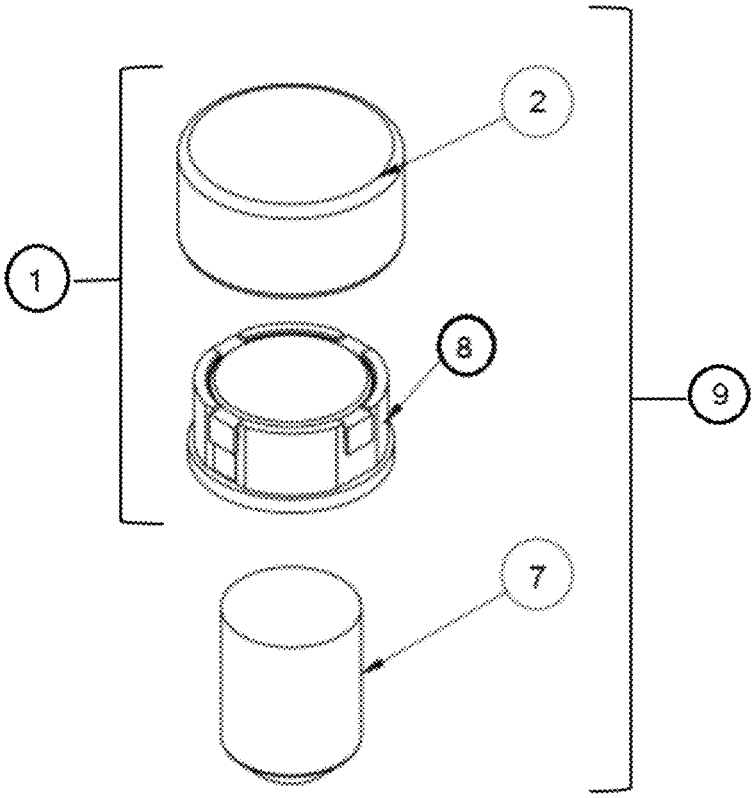
FIG. 1 represents the schematic exploded view of two main components of the container tamper detection capsule (1), according to the present invention, the set of members (8) and the top cover member (2), and also the stopper member (7), thus completing the set of members (9).

The present invention relates to a container tamper detection capsule based on NFC technology and to the process of operation thereof and to a container tamper detection process.

In the context of the present invention, the term "container" refers to an object with a closed shape generally of globular body, with a mouth or neck, intended to receive a food non-food product. The capsule of the present invention is intended, for example, for food product containers, namely for beverage containers, for example bottles for beverages selected from the group consisting of wine, beer, spirits, water, soft beverages and the like. Naturally, the capsule of the invention may also be used in containers for non-food products, since the nature of the capsule is not limited by the type of container that it can close or cover, nor by the product contained in that container.

The expression "mouth of the container" refers to the open part of a container, for example, the neck of a bottle.

The term "capsule" refers to a cover for closing or covering a container, staying arranged on the outside thereof, for example, covering the free end of the neck of a bottle, and the capsule may be associated with a stopper that remains arranged inside the mouth of the container. A capsule can be made from any suitable material, although it is normal to use plastic materials.

The expression "NFC tag adhesive" refers to an adhesive comprising any device with small microchips that can be read by other mobile devices, such as smartphones, at a certain distance, wherein the information is stored on those microchips.

In turn, the expression "stopper member (7)" refers to a body with a substantially cylindrical or conical shape with two ends. One end may be chamfered or rounded and is intended to be inserted partially or completely into the mouth or neck of a container, and the opposite end may be attached by any means to a capsule if so desired.

The expression "cork material" or simply "cork" refers to natural cork, colmated natural cork, agglomerated cork, microagglomerated cork or to combinations thereof.

The expression "plastic material" or simply "plastic" refers to polyethylene terephthalate (PET), polyethylene, high-density polyethylene (HDPE), polyvinyl chloride (PVC), polypropylene (PP), polystyrene (PS), acrylonitrile butadiene styrene (ABS) or similar or combinations thereof.

In the context of the present description, the term "comprising" should be understood as "including, among others". As such, the said term should not be interpreted as "consisting only of".

Said capsule is intended, in particular, to close containers containing beverages. This invention allows the detection of tampering of a container in an irreversible way, that is to say, without it being possible to revert the capsule mechanism to a non-tampering mode, and without the capsule undergoing any change at an aesthetic level, that is to say, the consumer can only detect whether or not the container has been tampered with using an NFC technology reading device.

The triggering of the capsule of the present invention occurs whenever a user pulls or tries to pull said capsule with the aim of removing it from the mouth or neck of a container.

The capsule of the present invention uses a detection mechanism that is based on the physical integrity of an NFC tag. When there is a tampering or attempted tampering of the capsule, the physical integrity of the NFC tag is compromised and is therefore detectable by electronic means, such as smartphones or tablets that have NFC technology.

The capsule of the present invention fully solves the problem identified in prior art capsules, preventing any removal or attempt to remove the capsule from being possible without triggering thereof, providing irreversible detection, carried out simply by electronic means and without causing damage or aesthetic change to the capsule, due to its new design and integration of an NFC tag.

With reference to FIG. 1 to 12, the capsule (1) of the present invention comprises a top cover member (2), a lid member (3), an NFC tag adhesive (4), a drive member (5) and a ring member (6), wherein

- the NFC tag adhesive (4) comprises a main component (4*a*) and a secondary component (4*b*), with the main component (4*a*) being glued to the drive member (5) and the secondary component (4*b*) glued to an inner side wall of the ring member (6),
- the lid member (3) is arranged jointly to the NFC detection member (4), forming the lid member (3), the NFC detection member (4) and the drive member (5) a joint assembly, and
- the ring member (6) contains the drive member (5) within and is closed by the lid member (3),
- the drive member (5) is configured to move within the ring member (6) between: i) a first closed position, on which the secondary component (4*b*) is glued to the ring member (6), and ii) a second opened position, on which the secondary component (4*b*) is separated from the main component (4*a*) of the NFC tag adhesive (4), and the drive member (5) is immobilized, both axially and longitudinally, in the ring member (6).

Figure 3:
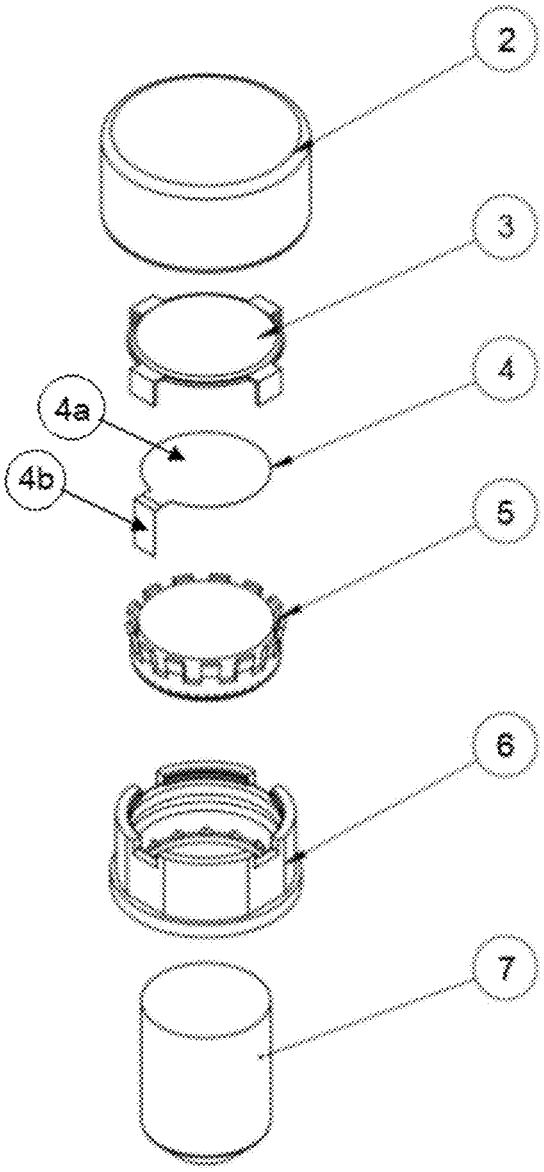
FIG. 3 represents the schematic exploded view of all components of the container tamper detection capsule (1), according to the present invention, including the stopper member (7)—the set of members (9).
Figure 4:
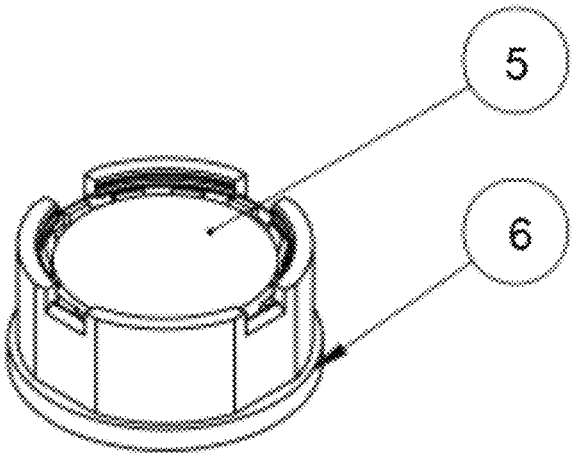
FIG. 4 shows the assembly of the drive member (5) on the ring member (6).
Figure 5:
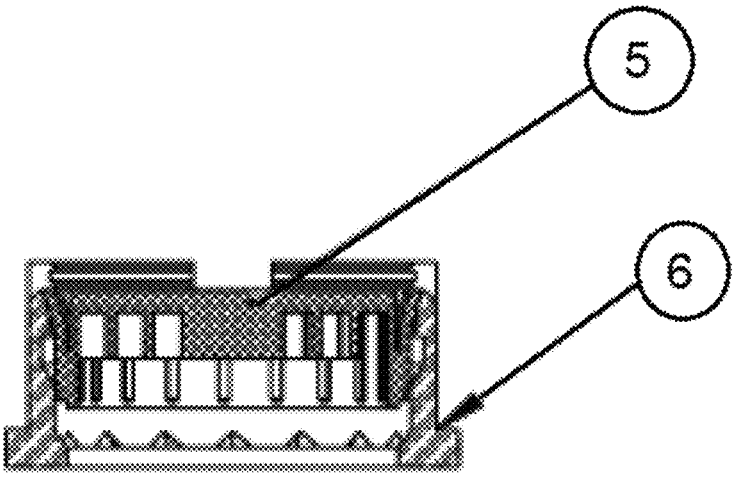
FIG. 5 represents the sectional view of the assembly of the drive member (5) on the ring member (6).
Figure 6:
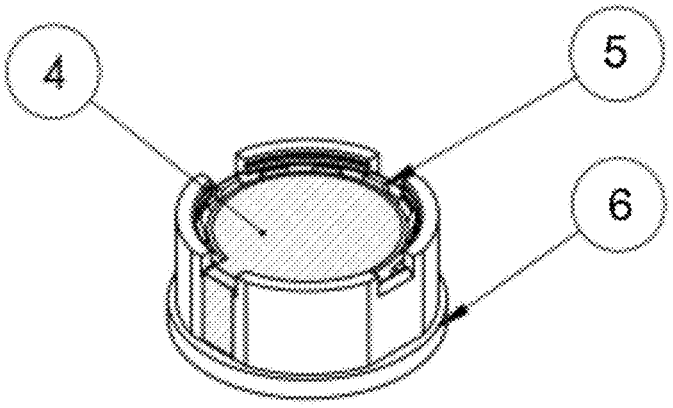
FIG. 6 shows the assembly of the NFC tag adhesive (4) on the drive (5) and (6) ring members.
Figure 7:
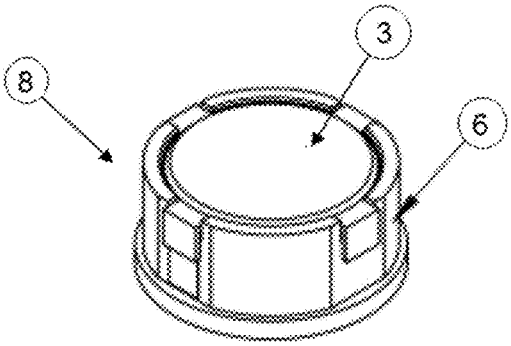
FIG. 7 represents the set of members (8) relating to the assembly of the lid member (3), NFC tag adhesive (4), drive member (5) and ring member (6).

The set (8) of members comprises four members (3, 4, 5 and 6), see FIGS. 1, 3 and 7, arranged in such a way that the members 3, 4 and 5 form a joint assembly that is configured to move longitudinally between positions within the ring member (6). In this configuration, the lid member (3) has the functions of closing and protecting the internal members (4) and (5).

Figure 2:
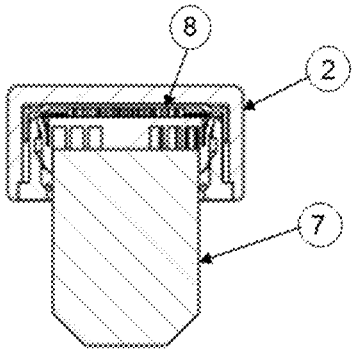
FIG. 2 shows the sectional view of the container tamper detection capsule (1) mounted on the stopper member (7).

In one embodiment, the top cover member (2) is arranged in order to externally cover said set (8) of members, the top cover member (2) being jointly connected to the members (3, 4 and 5) (FIGS. 1 and 2).

In another embodiment, the capsule comprises a stopper member (7) inserted and immobilized in the lower part of the ring member (5) (FIGS. 1 and 2). The stopper member (7) is axially, longitudinally and rotationally immobilized with respect to the ring member (6).

In one embodiment, the top cover member (2) is formed from a material selected from the group comprising plastic, wood, cork, composites and combinations thereof.

In another embodiment, the stopper member (7) is formed from a material selected from the group consisting of plastic, wood, cork, composites and combinations thereof.

The present invention also relates to a process of operating the container tamper detection capsule (1).

The operating process of the capsule (1) comprises the step of moving, from a first closed position to a second opened position, the assembly formed by the drive member (5), the NFC tag adhesive (4), and lid member (3) relative to the ring member (6), wherein

- in the first closed position, the main component (4*a*) of the NFC tag adhesive (4) is glued to the drive member (5) and the secondary component (4*b*) of the NFC tag adhesive (4) is glued to an inner side wall of the ring member (6); and
- in the second opened position a secondary component (4*b*) of the NFC tag adhesive (4) is physically separated from the main component (4*a*) of the NFC tag adhesive (4).

The present invention further relates to a container tamper detection process comprising the step of electronically detecting the physical integrity of an NFC tag adhesive (4) integrated into a container stopper capsule.

In one embodiment, the container tamper detection process further comprises the step of electronically detecting the physical separation of a secondary component (4*b*) relative to a main component (4*a*), both constituents of said NFC tag adhesive (4).

Lastly, the present invention relates to the use of the container tamper detection capsule (1) to close containers containing a beverage selected from the group comprising wine, beer, spirits, water and soft beverages.

Figure 11:
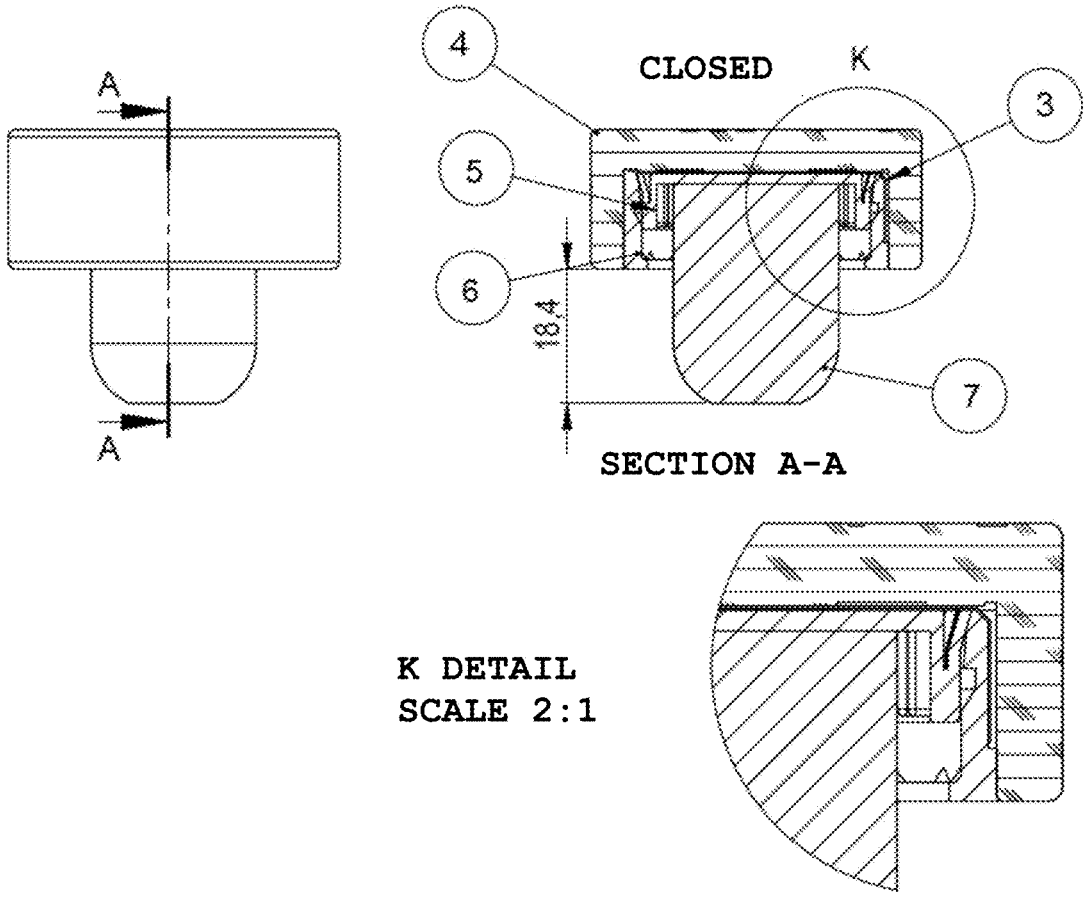
FIG. 11 shows the sectional view of the capsule, including the stopper member (7), in the closed configuration.
Figure 12:
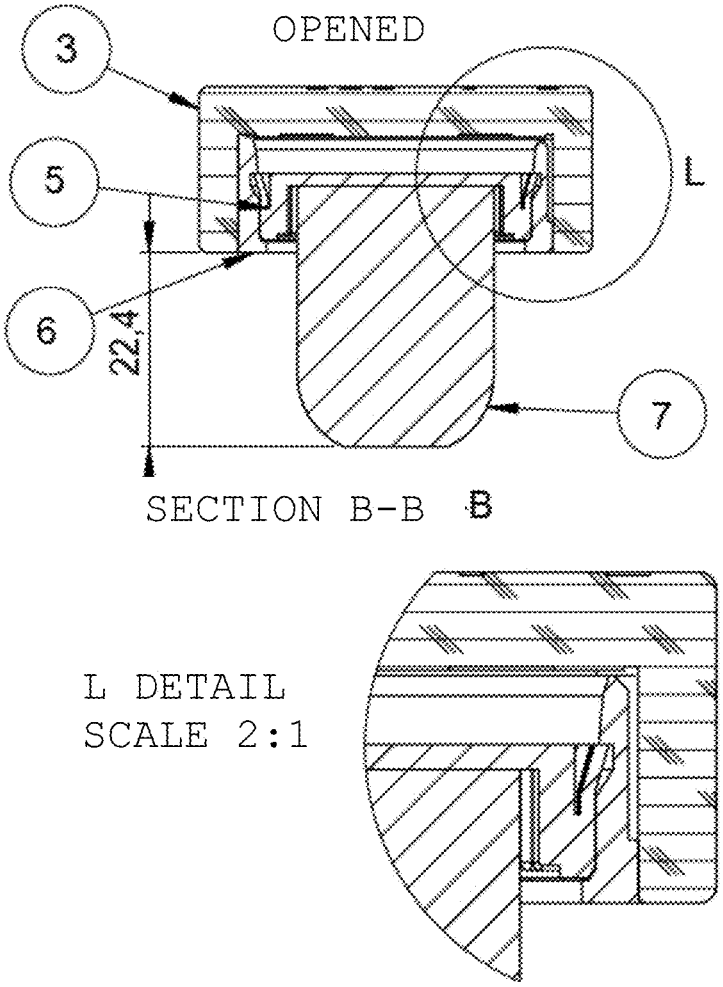
FIG. 12 shows the sectional view of the capsule, including the stopper member (7), in the open configuration.

The irreversibility of the mechanism of the present capsule is additionally achieved through the drive member (5) which, when moving to the opened position, is immobilized, both axially and longitudinally, in the ring member (6). This immobilization of the drive member (5) is achieved through the elastic deformation of the tabs (5*a*) present in the drive member (5), due to the narrower section present in the ring member (6) (FIGS. 11 and 12). After passing this narrowest section, the tabs (5*a*) of the drive member (5) return to their initial position, thus blocking the rotational movement of the drive member (5) to the closed position.

Preferably, the capsule (1) of the present invention comprises a stopper member (7) intended for closing containers containing a beverage, for example, wine, beer, spirits, water, soft beverages or the like.

With reference to the embodiment of FIG. 3, the container tamper detection capsule (1) is formed by five plastic parts: a top cover member (2), a lid member (3), an NFC tag adhesive (4), a drive member (5) and a ring member (6).

The lid member (3), the NFC detection adhesive (4) and the drive member (5) form a joint assembly. In turn, the ring member (6) contains the drive member (5) within. The NFC tag adhesive (4) comprises two components: a main component (4*a*) and a secondary component (4*b*). The main component (4*a*) is glued to the drive member (5) and the secondary component (4*b*) is glued to an inner side wall of the ring member (6).

Figure 8:
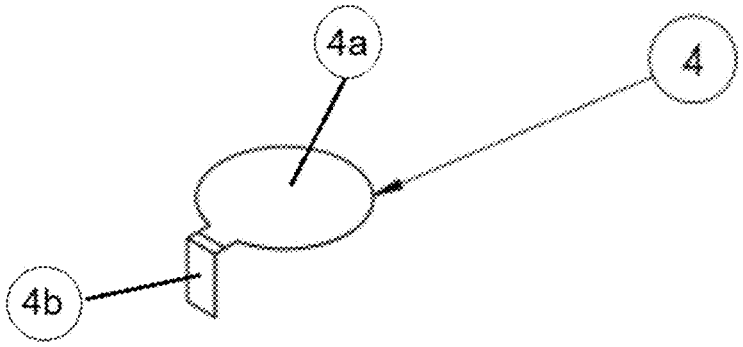
FIG. 8 is a representation of the NFC tag adhesive (4), showing the main (4*a*) and (4*b*) secondary components.
Figure 9:
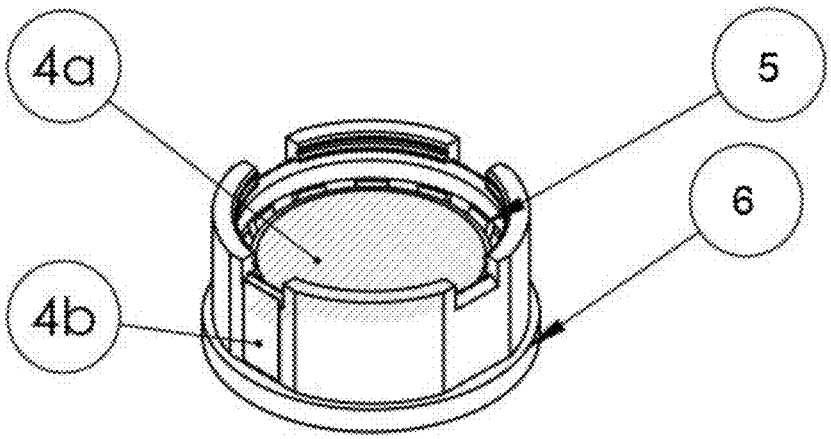
FIG. 9 shows the arrangement of the drive (5), (6) ring and NFC tag adhesive (4) members in the open configuration.
Figure 10:
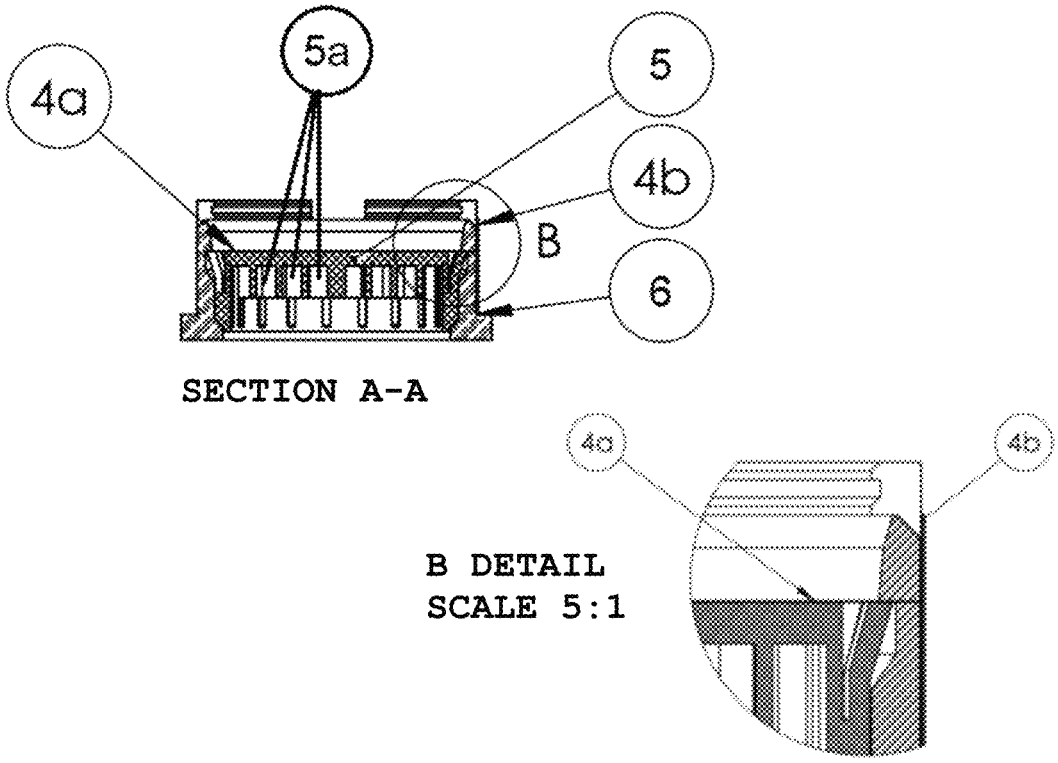
FIG. 10 represents the sectional view of the arrangement of the (5) drive, (6) ring and NFC tag adhesive (4) members in the open configuration, showing the main (4*a*) and (4*b*) secondary component of the NFC tag adhesive (4).

A cylindrical cork stopper is inserted and immobilized in the lower part of the ring member (5) and the top cover member (2) is arranged in order to externally cover said set of members (8), thus creating the capsule (1) of the present invention with a stopper member (7), wherein the members that make up the set of members (8) are inaccessible from the outside (FIGS. 1 and 8).

After this assembly, this union is irreversible and the capsule is in the untampered (closed) state (FIG. 11).

The capsule (1) thus formed is placed in a spirits bottle by inserting the cylindrical cork stopper into the neck of the bottle.

In order to trigger the capsule detection mechanism (1), the user pulls the set of members (9) in order to remove the cork from the bottle. With this movement, the drive member (5) moves relative to the ring member (6), and the secondary component (4*b*) breaks with its separation from the main component (4*a*) (FIGS. 9, 10 and 12), thus passing from the first closed position to the second opened position.

Tamper detection is carried out by breaking the secondary component (4*b*), which will allow the physical separation to be electronically detected with an NFC technology reading device, indicating the opened state to the consumer.

It should be noted that although the present invention has been described with reference to the preferred embodiments thereof, many modifications and alternatives can be made by a person skilled in the art without departing from the scope of the invention, which is defined by the claims.

The invention claimed is:

1. A container tamper detection capsule that comprises:

a top cover member, a lid member, an NFC tag adhesive, a drive member and a ring member, wherein the NFC tag adhesive comprises a main component and a secondary component, the main component being glued to the drive member and the secondary component glued to an inner side wall of the ring member, the lid member is arranged jointly to the NFC detection member, forming the lid member, the NFC detection member and the drive member a joint assembly, and the ring member contains the drive member within and is closed by the lid member, the drive member is configured to move within the ring member between:

i) a first closed position, on which the secondary component is glued to the ring member, and ii) a second opened position, on which the secondary component is separated from the main component of the NFC tag adhesive, and the drive member is immobilized, both axially and longitudinally, on the ring member.

2. The capsule according to claim 1, further comprising a stopper member inserted and immobilized in the lower part of the ring member.

3. The capsule according to claim 1, wherein the top cover member is arranged in order to externally cover said assembly formed by said members.

4. The capsule according to claim 1, wherein the stopper member is made of a material selected from the group consisting of plastic, wood, cork, composites and combinations thereof.

5. The capsule according to claim 1, wherein the top cover member is made of a material selected from the group consisting of plastic, wood, cork, composites and combinations thereof.

6. A process of operating the capsule according to claim 1, the process comprising:

moving, from a first closed position to a second opened position, the assembly formed by the drive member, the NFC tag adhesive, and lid member relative to the ring member, wherein in the first closed position, the main component of the NFC tag adhesive is glued to the drive member and the secondary component of the NFC tag adhesive is glued to an inner side wall of the ring member; and in the second opened position a secondary component of the NFC tag adhesive is physically separated from the main component of the NFC tag adhesive.

* * * * *